US010210850B2

(12) United States Patent
Kelly et al.

(10) Patent No.: US 10,210,850 B2
(45) Date of Patent: Feb. 19, 2019

(54) FLAME-TREATED DRUMSTICK

(71) Applicant: D'Addario & Company, Inc., Farmingdale, NY (US)

(72) Inventors: Bryan Kelly, Bay Shore, NY (US); Jason Talas, East Bernard, TX (US)

(73) Assignee: D'Addario & Company, Inc., Farmingdale, NY (US)

( * ) Notice: Subject to any disclaimer, the term of this patent is extended or adjusted under 35 U.S.C. 154(b) by 0 days.

(21) Appl. No.: 15/620,281

(22) Filed: Jun. 12, 2017

(65) Prior Publication Data

US 2017/0358281 A1 Dec. 14, 2017

Related U.S. Application Data

(60) Provisional application No. 62/348,308, filed on Jun. 10, 2016.

(51) Int. Cl.
*G10D 13/00* (2006.01)
*B27K 5/00* (2006.01)

(52) U.S. Cl.
CPC ..... *G10D 13/003* (2013.01); *B27K 5/001* (2013.01); *B27K 5/009* (2013.01)

(58) Field of Classification Search
CPC ..... G10D 13/003; B27K 5/001; B27K 5/009
See application file for complete search history.

(56) References Cited

U.S. PATENT DOCUMENTS 2,296,316 A * 9/1942 Stamm ..... B27K 3/0214 252/76
6,326,535 B1 * 12/2001 Pokallus ..... G10D 13/003 84/422.4

* cited by examiner

*Primary Examiner* — Kimberly Lockett
(74) *Attorney, Agent, or Firm* — Alix, Yale & Ristas, LLP

(57) ABSTRACT

A wooden drumstick that is treated by direct heating by exposure to a flame to improve hardness characteristics by altering the state of fibers in an outer layer of the drum stick relative to inner fibers below the outer layer. A method of manufacturing a treated drumstick includes selecting a wooden starting material, forming a drumstick profile from the wooden starting material, and exposing the drumstick profile directly to a flame.

20 Claims, 5 Drawing Sheets

FLAME-TREATED DRUMSTICK

BACKGROUND

This disclosure relates to a musical instrument drumstick made of wood, and in particular a drumstick made of wood that is treated with an open flame.

Drumsticks are typically made of a hard wood, such as oak, hickory, or maple, with either a lacquer or natural finish. It well established that the removal of moisture from the wood increases the playability of the drumstick. However, the conventional drying process does not alter the fibrous makeup of the outer portion of the drumstick.

Conventionally, a solid wood dowel is kiln dried to a certain percentage of moisture and subsequently transformed into a drumstick, a finished product, through the removal of wood from the dowel. The process of indirect heating in a kiln dries the dowel substantially uniformly throughout its cross section, to moisture content typically in the range of about 6% to about 10%.

SUMMARY

It would be useful to provide an improvement to the conventional uniform drying process to increase hardness, durability and visual aesthetics of a conventional drumstick by directly heating the outer layer of a drumstick with flame treatment.

In one embodiment, a method of manufacturing a treated wooden drumstick from an untreated wooden drumstick profile having an exterior surface comprises exposing the exterior surface of the untreated drumstick profile to a flame. The flame exposure alters wood fibers in an outer layer of the treated drumstick relative to inner wood fibers below the outer layer in the treated drumstick.

In another embodiment, a method of manufacturing a treated wooden drumstick from a wooden starting material is provided by selecting a wooden starting material and shaping the wooden starting material into a drumstick profile to produce an untreated drumstick having an outer surface. The untreated drumstick is treated by exposing the outer surface to a flame having a temperature within the approximate range of 2000 degrees F. to 4000 degrees F. to produce the treated drumstick. The flame exposure alters wood fibers in an outer layer of the treated drumstick relative to inner wood fibers below the outer layer in the treated drumstick.

In yet another embodiment, a wooden drumstick with a flame-treated exterior surface is provided, wherein wood fibers in an outer layer of the treated drumstick are altered relative to inner wood fibers below the outer layer in the treated drumstick.

BRIEF DESCRIPTION OF THE DRAWINGS

Aspects of the preferred embodiment will be described with reference to the drawings, wherein like numerals reflect like elements throughout.

DETAILED DESCRIPTION

Figure 1:
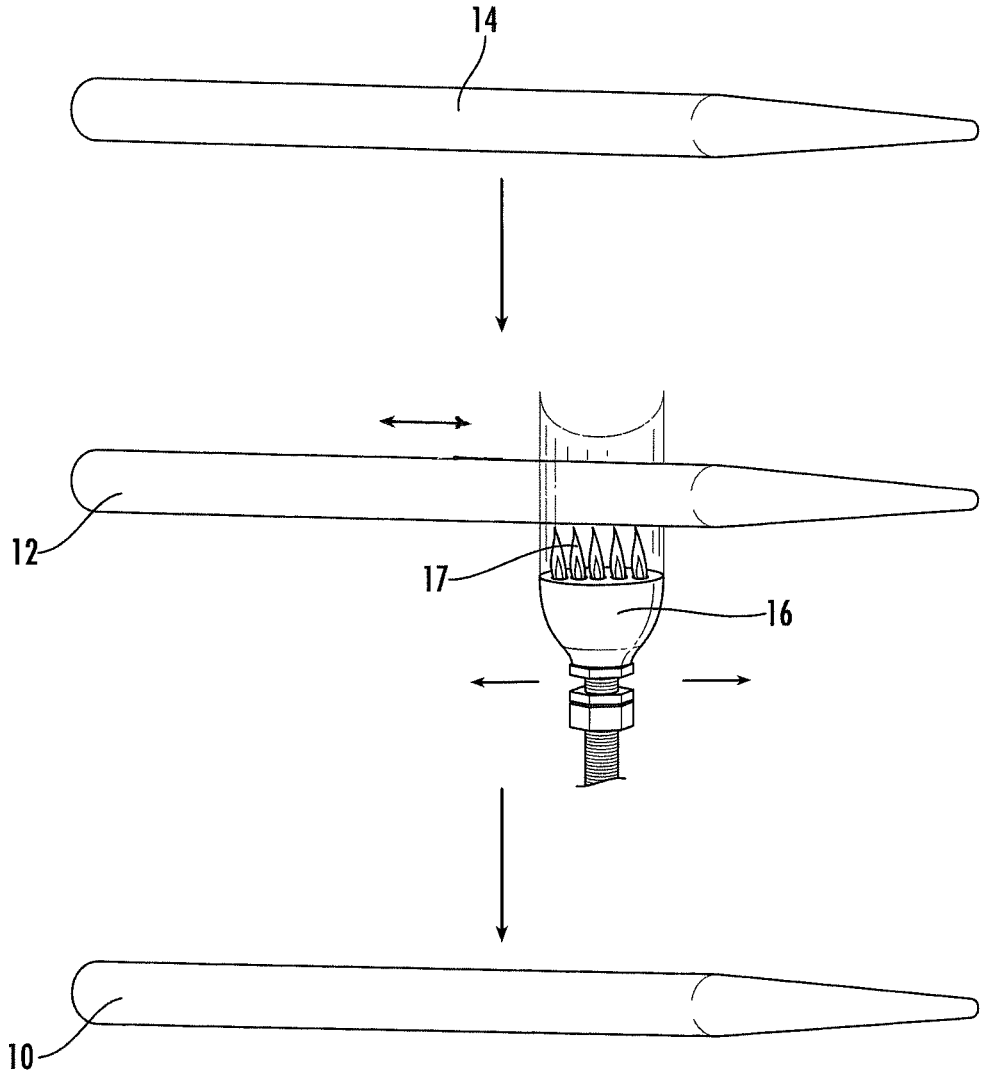
FIG. 1 shows a representation of a drumstick being flame-treated according to the disclosure.

Among the benefits and improvements disclosed herein, other objects and advantages of the disclosed embodiments will become apparent from the following wherein like numerals represent like parts throughout the several figures. Detailed embodiments of a flame-treated drumstick and a method of forming a flame-treated drumstick are disclosed; however, it is to be understood that the disclosed embodiments are merely illustrative of the invention that may be embodied in various forms. In addition, each of the examples given in connection with the various embodiments of the invention which are intended to be illustrative, and not restrictive.

Throughout the specification and claims, the following terms take the meanings explicitly associated herein, unless the context clearly dictates otherwise. The phrases "In some embodiments" and "in some embodiments" as used herein do not necessarily refer to the same embodiment(s), though it may. The phrases "in another embodiment" and "in some other embodiments" as used herein do not necessarily refer to a different embodiment, although it may. Thus, as described below, various embodiments may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on.

Further, the terms "substantial," "substantially," "similar," "similarly," "analogous," "analogously," "approximate," "approximately," and any combination thereof mean that differences between compared features or characteristics is less than 25% of the respective values/magnitudes in which the compared features or characteristics are measured and/or defined.

According to the present disclosure, a drumstick profile 14 formed by conventional machining and drying techniques is subsequently passed through either a single flame (17, 19) or an array of flames (21, 23) produced from an ignitable gas mixed with oxygen or compressed air to form a flame-treated drumstick 10. Precise flame temperature and feed rate of the intermediary drumstick 12 (i.e., drumstick during flame treatment) are controlled to prevent under- or over-treatment of the end drumstick 10. The flame or array of flames may be produced with a single ribbon burner 18, fishtail configuration 16, multi-burner configuration (20, 22) or any similar configuration to provide contiguous temperature and flame contact with the intermediate drumstick profile 12 during the flame treatment step.

Compared to a conventional non-flame treated, pre-dried drumstick 14, the flame-treated drumstick 10 in accordance with the present disclosure shows an increase in hardness (measured by recording the force required to indent the specimen with a hardened steel ball a preset distance; commonly referred to as the Janka hardness test for non-standard specimen) on the order of between about 4% and about 20%; more preferably between about 8% and about 16%; more preferably between about 10% and about 14% relative to the non-flame treated pre-dried stick. In a particularly preferred embodiment, the flame-treated drumstick 10 exhibits an increase in hardness of about 12%. Aspects of the flame treatment process can be altered to produce a treated drumstick 10 with different hardness properties as may be desired.

Figure 5:
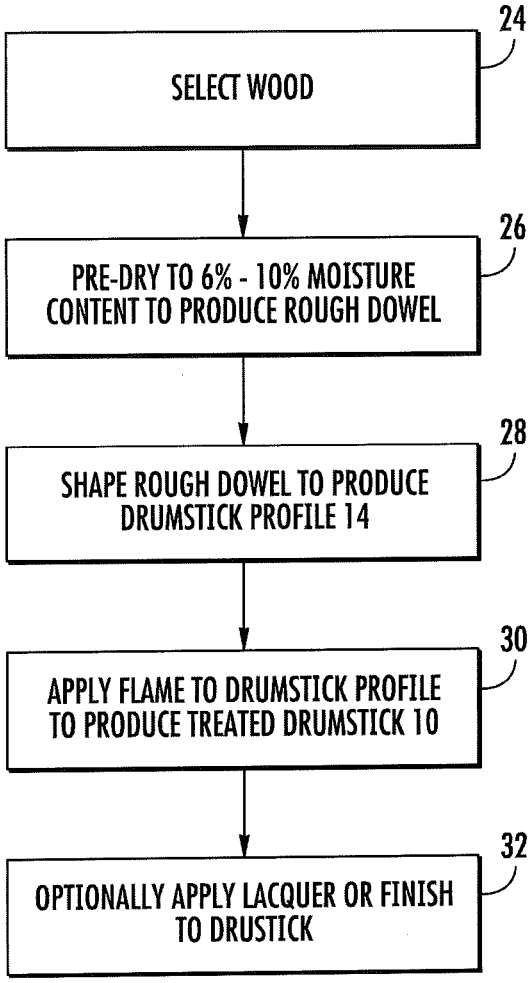
FIG. 5 is a flowchart depicting exemplary steps of forming a flame-treated drumstick according to the disclosure.

With reference to FIG. 5, a representative process for producing the flame-treated drumstick 10 is shown. A preferred process comprises the following sequential steps:

Selecting a type of wood (24);

Producing rough dowels from the wood selected in step 24, and pre-drying to moisture content in the range of about 6% to about 10% (26);

Forming a drumstick profile 14, typically by machining, such as with a lathe or grinder (28);

Applying a flame to the drumstick profile 14 to produce the finished drumstick 10 (30); and Applying lacquer or another finish to drumstick 10 (32).

As noted above, FIGS. 1-4 depict different flame source configurations appropriate for use in producing a flame-treated drumstick 10 in accordance with the disclosure. For example, FIG. 1 depicts direct flame treatment via a single fishtail burner system 16 where the flame 17 is traversed over the length of the intermediate drumstick 12, or the intermediate drumstick 12 is traversed through the burner flame 17, or a combination thereof, to produce a treated drumstick 10.

Figure 2:
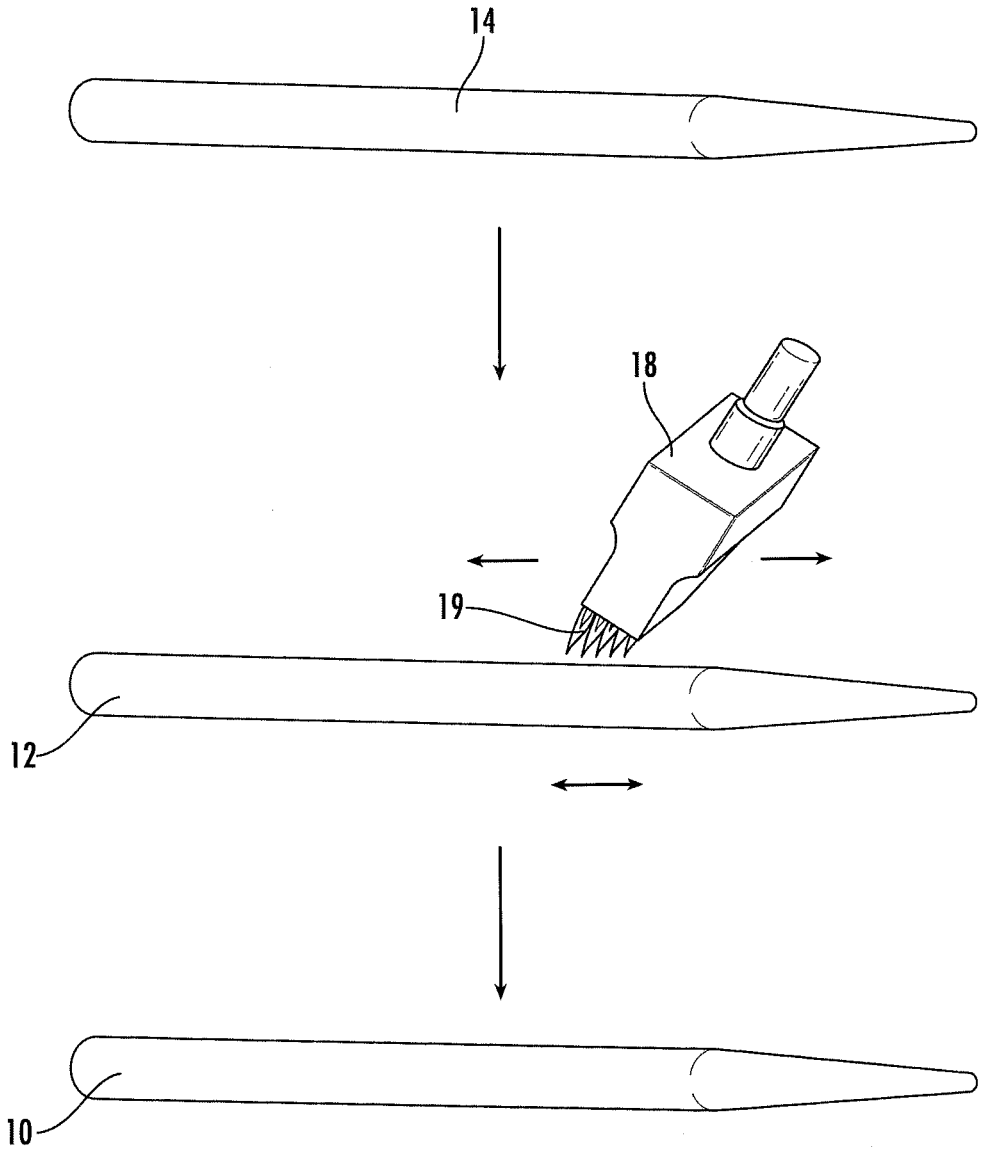
FIG. 2 shows another embodiment of a drumstick being flame-treated by a different type of flame.

In FIG. 2, the flame treatment is directly applied via a ribbon burner system 18 where the flame 19 is traversed over the length of the intermediate drumstick 12, or the intermediate drumstick 12 is traversed through the burner flame 19, or a combination thereof, to produce a treated drumstick 10.

Figure 3:
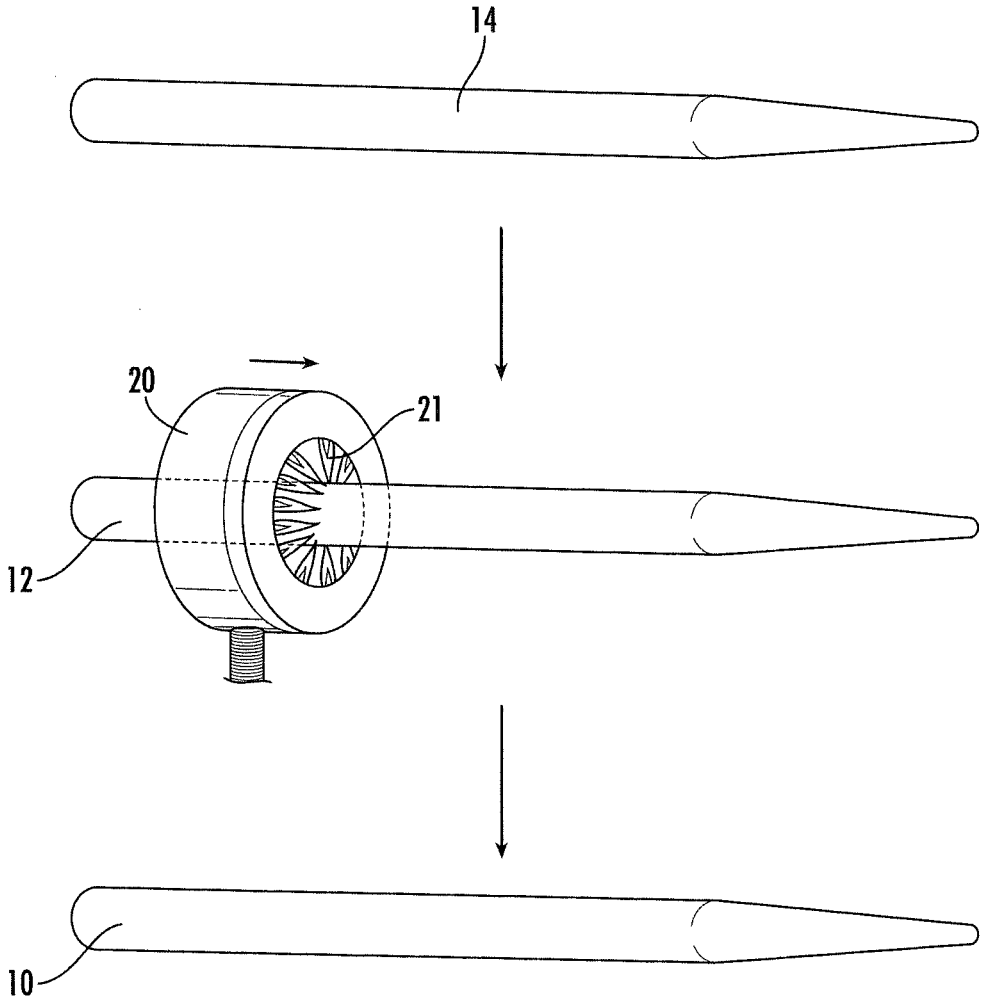
FIG. 3 shows another embodiment of a drumstick being flame-treated by yet another type of flame.

FIG. 3 depicts an embodiment wherein direct flame treatment of an intermediate drumstick 12 via a multi-burner system 20 arranged into a ring or similar form where the flame 21 is traversed over the length of the drumstick 12 to produce the treated drumstick 10.

Figure 4:
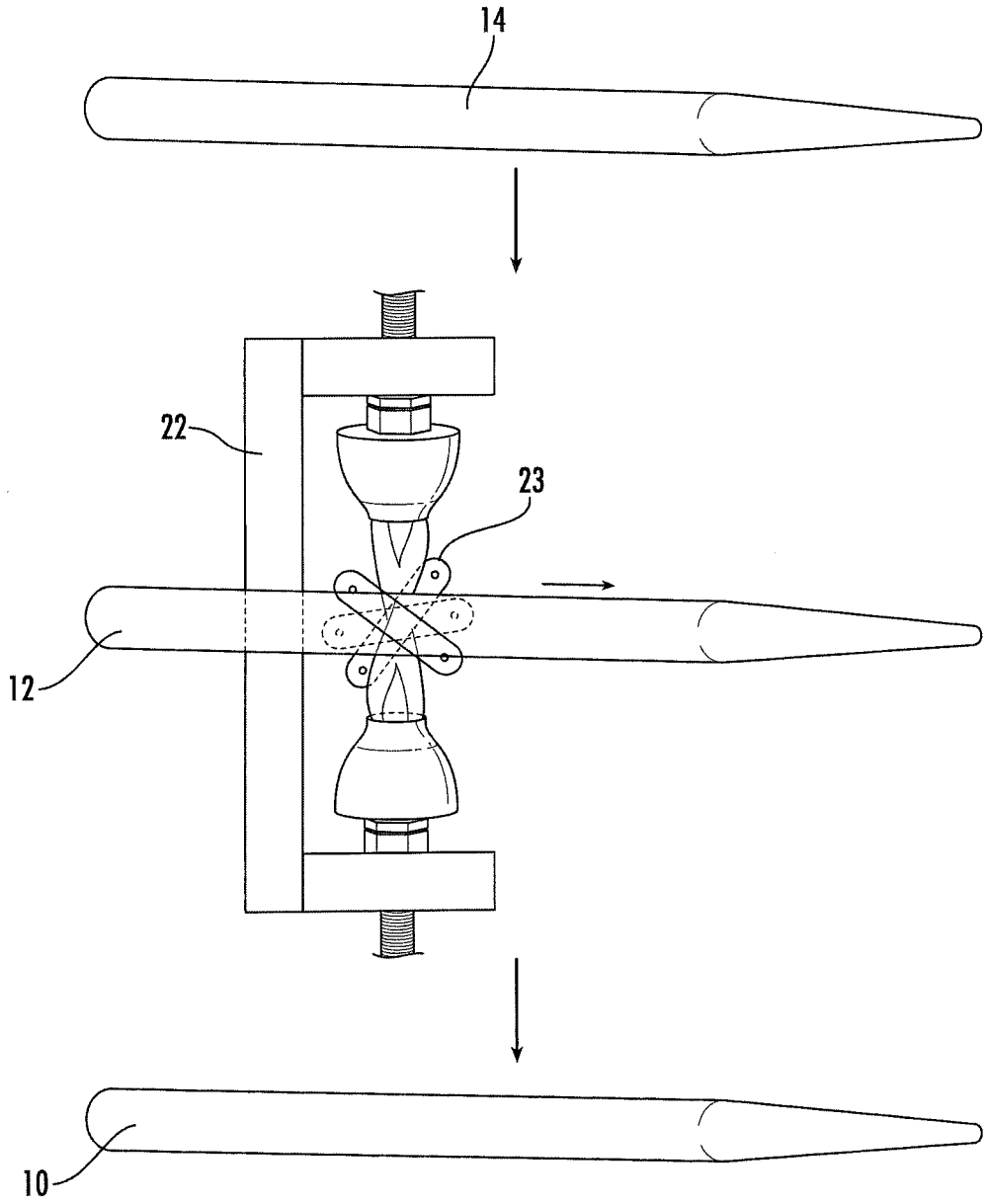
FIG. 4 shows another embodiment of a drumstick being flame-treated by yet another type of flame.

FIG. 4 shows an embodiment wherein flame treatment is applied by a different multi-burner system 22 where the intermediate stick 12 is traversed through the burner flame 23 to produce the treated drumstick 10. The configuration of FIG. 4 has been shown to be particularly preferable because it is facile to incorporate into an automated process.

In all embodiments, the drumstick can be rotated relative to the flame during treatment to assist in delivering a more even direct flame exposure to the outer surface.

Preferred process parameters for producing a flame-treated drumstick 10 from raw hickory starting material include:

1) Fuel: propane (2-8) PSI and compressed air (18-20 PSI).

2) Flame temperature: 3500-3600° F., and more particularly approximately 3570° F.

3) Feed rate: 5-15 feet per minute, and more particularly approximately 10 feet per minute.

4) Post-flame-treatment coating: lacquered finish.

While the above example is for a drumstick made from raw hickory, the process is similar for other woods typically used in forming drumsticks, such as, for example, maple and oak. The primary consideration is that the flame temperature for applying direct heat is high enough to alter the wood fiber at and near the outer surface (i.e., the outer layer) relative to inner wood fibers below the outer layer, but not so high so as to combust the wood. This balance is generally found with an intensified flame at over 2000° F. contacting the wood surface, and more particularly over 3000° F., with careful monitoring of throughput. Embodiments of the flame treatment process utilize flames of up to about 4000° F.

Although starting with a pre-dried dowel is preferred, as disclosed above, flame treatment on relatively green dowels can also produce treated drumsticks 10 with surfaces that are harder than in conventional drumsticks. Accordingly, the pre-drying step 26 represented in FIG. 5 is non-limiting to the inventive concepts described herein. Additionally, the preferred range of target moisture content identified in step 26 is non-limiting, as drumstick profiles 14 have been formed from wood starting materials having moisture outside of 6-10%.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed is:

1. A method of manufacturing a treated wooden drumstick from an untreated wooden drumstick profile having an exterior surface, comprising exposing the exterior surface of the untreated drumstick to a flame, thereby altering wood fibers in an outer layer of the treated drumstick relative to inner wood fibers below the outer layer in the treated drumstick.

2. The method of claim 1, wherein the flame has a temperature of at least 2000 degrees Fahrenheit.

3. The method of claim 1, wherein the flame has a temperature within the range of approximately 2000 degrees Fahrenheit to approximately 4000 degrees Fahrenheit.

4. The method of claim 1, including the steps of (a) selecting a wooden dowel that is dried to a moisture content in the range of 6-10%;

(b) shaping the pre-dried dowel into a drumstick profile to produce the untreated drumstick; and (c) treating the untreated drumstick by exposing the outer surface to a flame having a temperature within the approximate range of 2000 degrees Fahrenheit to 4000 degrees Fahrenheit to produce the treated drumstick.

5. The method of claim 4, wherein the flame temperature is over 3000 degrees Fahrenheit.

6. The method of claim 5, wherein the step (c) of treating is performed by exposing the exterior surface of the untreated drumstick to the flame at a feed rate of approximately 5-15 feet per minute.

7. The method of claim 4, comprising the additional step of (d) applying a coating of lacquer to the treated drumstick.

8. The method of claim 1, wherein the flame has a temperature over 3000 degrees Fahrenheit.

9. The method of claim 4, wherein the temperature of the flame is within the approximate rage of 3500-3600 degrees Fahrenheit.

10. A wooden drumstick with a flame-treated exterior surface, wherein wood fibers in an outer layer of the treated drumstick are altered relative to inner wood fibers below the outer layer in the treated drumstick.

11. The drumstick of claim 10, wherein the entire exterior surface is flame-treated.

12. The drumstick of claim 10, having an increased hardness relative to an untreated drumstick of the same wood material of between about 4% to about 20%.

13. The drumstick of claim 12, having an increased hardness relative to an untreated drumstick of the same wood material of between about 10% to about 14%.

14. The drumstick of claim 12, having an increased hardness relative to an untreated drumstick of the same wood material of approximately 12%.

15. A method of manufacturing a treated wooden drumstick from a wooden starting material, comprising the steps of:

(a) selecting a wooden starting material;

(b) shaping the wooden starting material into a drumstick profile to produce an untreated drumstick having an outer surface; and (c) treating the untreated drumstick by exposing the outer surface to a flame having a temperature within the approximate range of 2000 degrees Fahrenheit to 4000 degrees Fahrenheit to produce the treated drumstick, wherein the flame exposure alters wood fibers in an outer layer of the treated drumstick relative to inner wood fibers below the outer layer in the treated drumstick.

16. The method of claim 15, wherein the alteration of wood fibers in the outer layer results in a treated drumstick that is approximately 8% to approximately 16% harder than the untreated drumstick.

17. The method of claim 15, wherein the untreated drumstick is exposed to the flame at a rate of approximately 5-15 feet per minute.

18. The method of claim 15, wherein the wooden starting material is selected from the group consisting of raw hickory, maple and oak.

19. The method of claim 15, comprising a layer of lacquer on the outer surface of the treated drumstick.

20. The method of claim 15, wherein the alteration of wood fibers in the outer layer results in a treated drumstick that is approximately 12% harder than the untreated drumstick.

* * * * *